US006616493B2

(12) United States Patent
Powell et al.

(10) Patent No.: US 6,616,493 B2
(45) Date of Patent: Sep. 9, 2003

(54) FLOATABLE BEVERAGE HOLDER

(76) Inventors: Steven C. Powell, 105 NE. Edgewater Dr., Lee's Summit, MO (US) 64064; Steven L. Kulcsar, 1333 SW. Surrey Trace, Lee's Summit, MO (US) 64081

( * ) Notice: Subject to any disclaimer, the term of this patent is extended or adjusted under 35 U.S.C. 154(b) by 0 days.

(21) Appl. No.: 09/682,834

(22) Filed: Oct. 23, 2001

(65) Prior Publication Data

US 2003/0077958 A1 Apr. 24, 2003

(51) Int. Cl.[7] ..... B63B 22/00
(52) U.S. Cl. ..... 441/1; 206/427; 220/560
(58) Field of Search ..... 441/1, 136, 81, 441/129, 130; 206/427; 220/560

(56) References Cited

U.S. PATENT DOCUMENTS 3,367,525 A * 2/1968 Elder ..... 220/560
3,831,209 A * 8/1974 Clingman ..... 441/136
4,571,194 A * 2/1986 Kiss et al. ..... 441/1
4,651,873 A * 3/1987 Stolcenberg et al. ..... 206/142
4,887,716 A * 12/1989 Abraham ..... 441/1
5,447,764 A * 9/1995 Langford ..... 220/560
5,727,709 A * 3/1998 Nobile ..... 220/560
6,014,833 A * 1/2000 Benavidez ..... 220/560
6,016,933 A * 1/2000 Daily et al. ..... 220/560

* cited by examiner

*Primary Examiner*—S. Joseph Morano
*Assistant Examiner*—Lars A. Olson
(74) *Attorney, Agent, or Firm*—Hovey Williams LLP

(57) ABSTRACT

A buoy which is suitable for supporting various sizes of beverage containers and allows the center of gravity of the combined buoy and container to be readily adjusted in order to restrain tipping.

21 Claims, 2 Drawing Sheets

FLOATABLE BEVERAGE HOLDER

BACKGROUND OF THE INVENTION

1. Field of the Invention

The present invention relates generally to buoyant devices for supporting otherwise unfloatable objects on a liquid. In another aspect, the invention concerns a buoy for supporting a container in a generally upright position when the combined buoy and container are placed in water. In a further aspect, the invention concerns a buoy which is suitable for supporting various sizes of conventional beverage containers and allows the center of gravity of the combined buoy and container to be readily adjusted in order to restrain tipping.

2. Discussion of Prior Art

Persons who enjoy recreational water activities, such as swimming and fishing, frequently desire access to beverages while in the water. However, during such recreational activities, it is typically undesirable to continuously hold a beverage because the use of both hands may be necessary to fully enjoy the recreational activity.

To address this problem, a variety of conventional floating beverage holders have been developed which can support one or more beverage containers on the surface of the water. Existing floating beverage holders, however, present a number of drawbacks. For example, most conventional floating beverage holders will not accommodate beverage containers of various sizes (i.e., having varying outside diameters). This is particularly disadvantageous when a person desires to use a beverage insulator to keep their beverage hot or cold. Because the thickness of conventional beverage insulators can vary greatly depending on their specific material of construction, insulated beverage containers will frequently not be suitable for use with conventional floating beverage holders. Further, even if the conventional floating beverage holder is designed to accommodate insulated beverage containers, such beverage holders are typically not suited for accommodating uninsulated beverage containers.

A further disadvantage of existing floating beverage holders is their size. The bulkiness of these conventional devices make it undesirable and/or impractical to pack, transport, and store these devices. This disadvantage is especially pronounced when persons enjoy recreational water activities at locations requiring substantial travel. When packing a limited amount of supplies to travel to a remote recreation location, including a bulky conventional floating beverage holder may simply be impractical.

A still further disadvantage of conventional floating beverage holders is the fact that the beverage container must be removed and reinserted into the holder every time the user takes a drink. This removal/reinsertion action can be difficult in the water, and often requires the use of two hands to grasp both the holder and the beverage container. The use of two hands to remove and reinsert the beverage into the holder can make the use of conventional floating beverage holders impractical, especially when enjoying recreational activities requiring the use of two hands.

Another disadvantage of conventional floating beverage holders is the inability to adjust the center of gravity of the combined holder and beverage container. This inability to adjust the center of gravity can be particularly disadvantageous when tall beverage containers, such as some conventional water bottles, are supported by the floating beverage holder.

An additional disadvantage of conventional floating beverage holders is that they tend to float away from the individual, thus making it necessary for the individual to relocate towards the beverage holder in order to take a drink of the beverage.

SUMMARY OF INVENTION

Responsive to these and other problems, an important object of the present invention is to provide a floating beverage buoy suitable for use with a variety of sizes of containers.

A further object of the present invention is to provide a floatable beverage buoy having a compact shape (especially a minimal thickness) which allows it to be easily packed, transported, and stored.

A still further object of the present invention is to provide a floating beverage buoy having a compact shape and low weight which allows the buoy and the container to be readily manually manipulated as a single unit (i.e., a person can easily lift and consume liquids from the container without removing the container from the buoy).

Another object of the present invention is to provide a floating beverage buoy wherein the center of gravity of the combined buoy and beverage container can be readily manually adjusted in order to restrain tipping.

Still another object of the present invention is to provide a floating beverage buoy which prevents the buoy and beverage container from floating away from an individual user and provides a means by which the container can be retrieved if it has floated out of the reach of the individual user.

It should be noted that not all of the above-listed objects need be accomplished by the invention claimed herein and other objects and advantages of this invention will be apparent from the following description of the invention and appended claims.

In accordance with one embodiment of the present invention, a buoy for supporting any one of a variety of sizes of containers in a generally upright position when the buoy and supported container are placed in water is provided. The buoy generally comprises a buoyant body, a generally circular opening, and a resilient holding member. The opening extends through the body along an opening axis and is adapted to receive the container. The resilient holding member defines at least a portion of the opening and is adapted to frictionally engage the container when the container is received in the opening. The resilient holding member is sufficiently flexible to allow the diameter of the opening to be varied by at least 10 percent without causing substantial plastic deformation of the resilient holding member.

In accordance with another embodiment of the present invention, a buoy for supporting any one of a variety of sizes of containers in a generally upright position when the buoy and supportive container are placed in water is provided. The buoy comprises a body which presents an inner surface. The inner surface at least partially defines an opening extending through the body along an opening axis. The opening is adapted to receive the container. The inner surface presents a tapered portion. The tapered portion extends at a taper angle which is oblique relative to the opening axis when the container is not received in the opening. At least part of the tapered portion is elastically deformed by and frictionally engages the container when the container is received in the opening.

In accordance with a further embodiment of the present invention, a buoy for supporting any one of a variety of sizes of containers in a generally upright position when the buoy and supportive container are placed in water is provided. The buoy generally comprises a body presenting an outer perimeter and defining an opening extending through the body along an opening axis. The opening is adapted to receive the container. The body defines a plurality of spaced-apart, open slots extending between the opening and the outer perimeter. The open slots include an open end positioned adjacent the opening and a closed end positioned between the opening and the outer perimeter. The open slots allow the body to be sufficiently deformed so that the size of the opening can be varied to accommodate containers having various outer diameters without causing substantial plastic deformation of the body.

BRIEF DESCRIPTION OF DRAWINGS

Preferred embodiments of the invention are described in detail below with reference to the attached drawing figures, wherein.

DETAILED DESCRIPTION

Figures 1, 2:
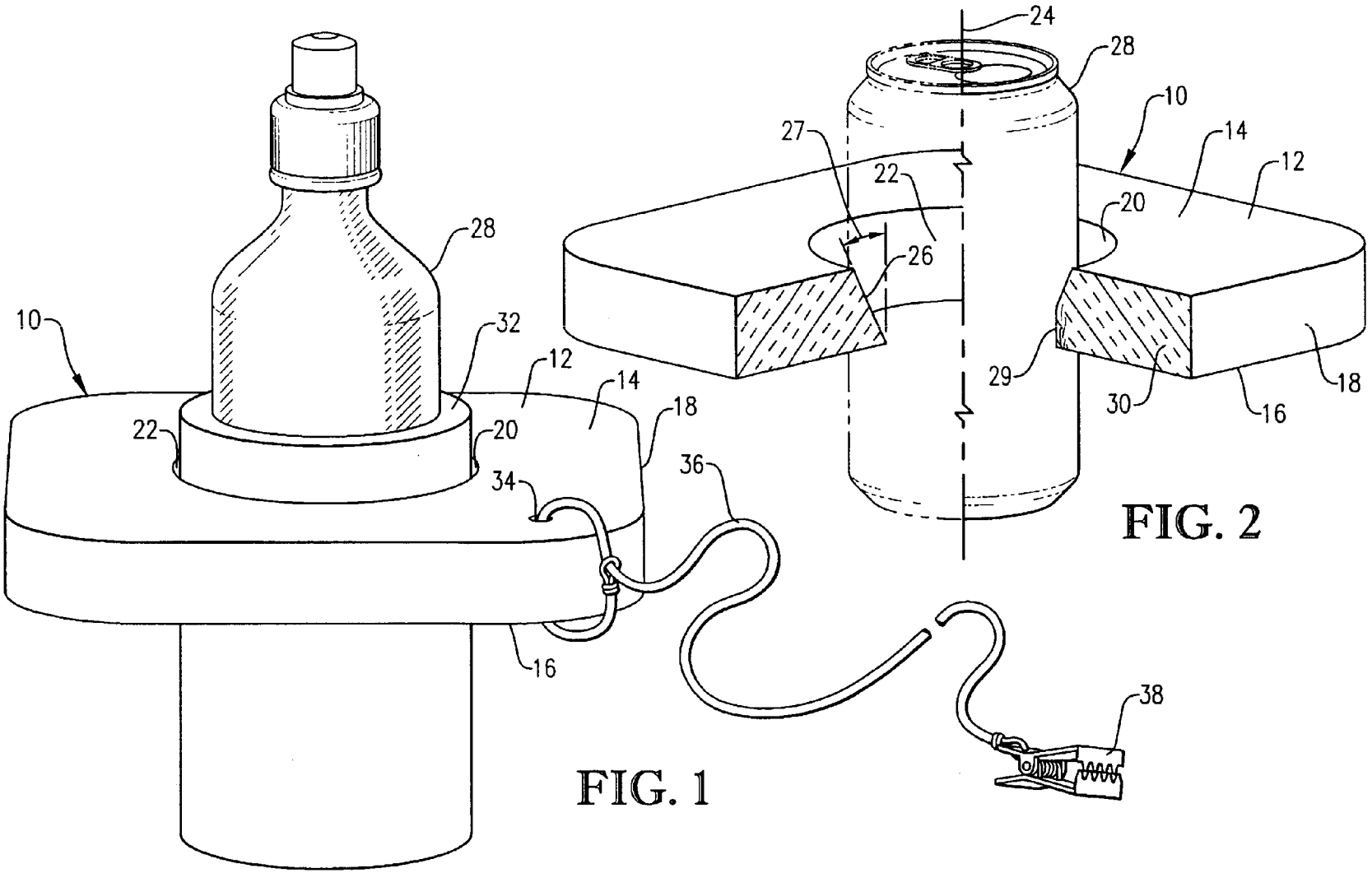
FIG. 1 is a perspective view of a buoy and tether system constructed in accordance with he principles of the present invention, with the buoy receiving a conventional insulated water bottle.
FIG. 2 is a partial sectional perspective view of the buoy further illustrating the tapered inner surface which defines the opening for receiving the beverage container.
Figure 3:
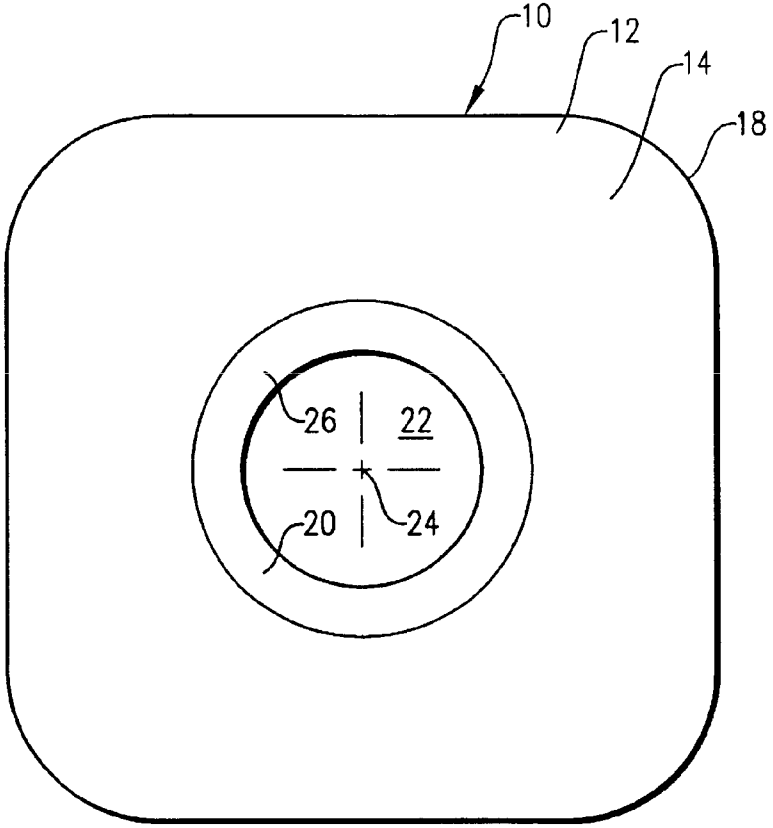
FIG. 3 is a top view of the buoy shown in FIGS. 1 and 2.

Referring initially to FIGS. 1–3, a floating beverage buoy 10 in accordance with one embodiment of the present invention is illustrated. Buoy 10 generally comprises a body 12 presenting an upper surface 14, a lower surface 16, an outer perimeter 18, and an inner surface 20.

Referring to FIG. 2, inner surface 20 defines an opening 22 which extends through body 12 along an opening axis 24. Inner surface 20 includes a tapered portion 26 extending at a taper angle 27 which is oblique relative to opening axis 24. Preferably, substantially all of inner surface 20 is tapered. Taper angle 27 of tapered portion 26, measured relative to opening axis 24, is preferably in the range of from about 15 degrees to about 75 degrees, more preferably in the range of from about 30 degrees to about 60 degrees, and most preferably in the range of from 40 degrees to 50 degrees.

As shown in FIG. 2, when a container 28 is received in opening 22, at least a portion of tapered portion 26 (i.e., a deformed portion 29) is elastically deformed by and frictionally engages the outer surface of container 28. Body 12 of buoy 10 is preferably composed of a resilient material 30 which allows tapered portion 26 to be deformed when container 28 is received in opening 22 without causing substantial plastic deformation of tapered portion 26. The shape of inner surface 20 provides opening 22 with a generally frustoconical shape having a wide portion of opening 22 proximate upper surface 14 and a narrow portion proximate lower surface 16.

The configuration of inner surface 20 combined with the resilient properties of body 12 allows the diameter of opening 22 to be varied without causing substantial plastic deformation of body 12. Preferably, the minimum diameter of opening 22 can be varied by more than 10 percent without causing substantial plastic deformation of body 12, more preferably the minimum diameter of opening 22 can be varied by more than 20 percent without causing substantial plastic deformation of body 12, still more preferably the minimum diameter of opening 22 can be varied by more than 35 percent without causing substantial plastic deformation of body 12, and most preferably the minimum diameter of opening 22 can be varied by more than 50 percent without causing substantial plastic deformation of body 12. Thus, opening 22 allows a variety of containers having outer diameters varying by more than 10, 20, 35 or even 50 percent to be accommodated by the same buoy 10. Preferably, the minimum diameter of opening 22 is from about 1.5 to about 3.5 inches, more preferably from about 1.75 to about 3.25 inches, still more preferably from about 2.0 to about 3.0 inches, and most preferably from 2.25 to 2.75 inches. As used herein, the term "minimum diameter" of opening 22 shall mean the minimum distance measured on a straight line extending through opening axis 24 between opposing sides of inner surface 20. In the embodiment shown in FIG. 2, such minimum diameter of opening 22 will occur proximate lower surface 16 of body 12 due to the tapered shape of inner surface 20.

The frictional force imparted on the outside surface of container 28 by deformed portion 29 of inner surface 20 when container 28 is received in opening 22 is sufficient to at least substantially restrain shifting of container 28 relative to body 12 when container 28 and buoy 10 are placed in the water. The frictional engagement force between body 12 and container 28 should further be sufficient to restrain shifting of container 28 relative to body 12 when container 28 is grasped by an individual and lifted out of the water in order to consume a beverage from container 28. However, the frictional engagement force between body 12 and container 28 should be small enough to readily permit manually-assisted shifting of container 28 relative to body 12 along opening axis 24, to thereby allow the center of gravity of the combined buoy 10 and container 28 to be adjusted.

Buoy 10 preferably has a relatively compact, flattened shape. Thus, it is preferred for upper and lower surfaces 14, 16 of body 12 to be substantially flat and to extend substantially perpendicular to opening axis 24. The distance between upper and lower surfaces 14, 16 is preferably minimized in order to provide a more compact buoy 10. As such, the maximum body thickness of body 12 is preferably less than the minimum body width of body 12. As used herein, the term "maximum body thickness" shall mean the maximum distance between any two portions (typically a point on upper surface 14 and a point on lower surface 16) of body 12 measured along a line which is parallel to opening axis 24. As used herein, the term "minimum body width" shall mean the minimum distance between any two points on outer perimeter 1 8 measured on a straight line extending through opening axis 24. Preferably, the maximum body thickness of body 12 is less than one-half the minimum body width, more preferably the maximum body thickness is less than one-fourth the minimum body width. When buoy 10 is employed to support conventional beverage containers, the maximum body thickness is preferably less than about 2 inches, more preferably less than about 1.5 inches, still more preferably less than about 1 inch, and most preferably between 0.5 inches and 1 inch. Further, when buoy 10 is employed to support conventional beverage containers, the minimum body width is preferably more than about 4 inches, more preferably more than about 5 inches, still more preferably more than about 6 inches, and most preferably between 6 and 9 inches.

In order to achieve sufficient buoyancy to support container 28 in water, body 12 must be composed of a material having a relatively low density. Preferably, resilient material 30 of body 12 has a specific gravity of less than about 0.5, more preferably less than about 0.2, and most preferably less than 0.1. Resilient material 30 can be any material having the physical properties described above, such as, for example, a flexible foam material known in the art as Nitrile.

Referring to FIG. 1, buoy 10 can also be employed to support container 28 when container 28 is received in an insulator 32. Further, FIG. 1 shows that body 12 can include a hole 34 to which a tether 36 can be attached. A clip 38 can be coupled to the end of tether 36 opposite the end of tether 36 coupled to body 12. Clip 38 can be any manually operable clip known in the art which can be readily secured to an anchoring device such as, for example, an article of clothing worn by the user of buoy 10. Thus, tether 36 can prevent buoy 10 from floating out of the reach of the user. Further, tether 36 can be used to retrieve buoy 10 by simply pulling tether 36 towards the user.

Figure 4:
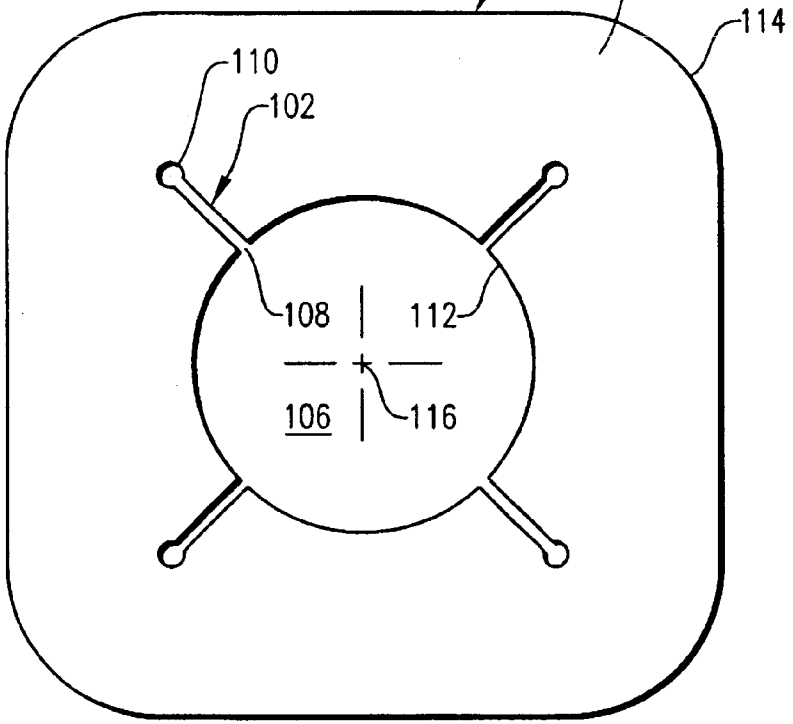
FIG. 4 is a top view of an alternative buoy constructed in accordance with the principles of the present invention, wherein the buoy includes a plurality of open slots to provide the flexibility necessary to receive and support beverage containers of various sizes.

Referring to FIG. 4, an alternate buoy 100 design is shown. Buoy 100 employs open slots 102 in a body 104 to provide for the expansion of an opening 106 necessary in order for buoy 100 to support a variety of containers having various outer diameters. Open slots 102 in body 104 include an open end 108 positioned adjacent opening 106 and a closed end 110 positioned between an inner surface 112 and an outer perimeter 114. Open slots 102 extend generally radially outwards, relative to an opening axis 116, from opening 106 into body 104. Open slots 102 extend completely through body 104 in a direction which is at least substantially parallel to opening axis 116. Inner surface 112 extends substantially parallel to opening axis 116 to thereby give opening 106 a generally cylindrical shape. A plurality of open slots 102 are preferably employed, more preferably at least 3 open slots are employed, and most preferably 4 open slots are employed.

When a container is forced into opening 106, the diameter of opening 106 is increased due to elastic deformation of the portions of body 104 positioned adjacent opening 106 and generally between adjacent open slots 102. Such deformed portions of body 104 can be deformed outwardly in a direction at least substantially perpendicular to opening axis 116. Further, such deformed portions of body 104 can be deformed in a direction substantially parallel to the opening axis, to thereby expand opening 106. Body 104 is formed of a material which allows body 104 to be deformed to hold various sizes of containers without causing substantial plastic deformation of body 104.

The compact size, material of construction, and degree of opening adjustability of buoy 100 is preferably substantially the same as described above with reference to FIGS. 1–3.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the doctrine of equivalence to determine and assess the reasonably fair scope of the present invention as pertains to any apparatus not materially departing from but outside the literal scope of the invention as set forth in the following claims.

What is claimed is:

1. A buoy for supporting any one of a variety of sizes of containers in a generally upright position when the buoy and supported container are placed in water, said buoy comprising:

a buoyant body;

a generally circular opening extending entirely through the body along an opening axis and adapted to receive the container; and a resilient holding member defining at least a portion of the opening and adapted to frictionally engage the container when the container is received in the opening, said resilient holding member being sufficiently flexible to allow generally cylindrical containers having outer diameters varying by at least 35 percent to be received in the opening without causing substantial plastic deformation of the resilient holding member, said holding member being at least partly defined by a plurality of spaced-apart slots, each of said slots commencing at the opening and extending from the opening into the body.

2. A buoy according to claim 1, said resilient holding member adapted to at least substantially restrain shifting of the container relative to the body when the container is received in the opening.

3. A buoy according to claim 2, said resilient holding member adapted to permit manually-assisted shifting of the container relative to the body along the opening axis, thereby allowing the center of gravity of the combined buoy and container to be adjusted.

4. A buoy according to claim 3, said body having a maximum body thickness which is less than a minimum body width of the body.

5. A buoy according to claim 4, said maximum body thickness being less than one-half the minimum body width.

6. A buoy according to claim 4, said holding member having a maximum holding member height, measured parallel to the opening axis, which is less than twice the maximum body thickness.

7. A buoy according to claim 6, said maximum holding member height being substantially equal to the maximum body thickness.

8. A buoy according to claim 7, said maximum body thickness being less than about 2 inches, said minimum body width being more than about 4 inches, said opening having a minimum diameter in the range of from about 1.5 inches to about 3.5 inches.

9. A buoy according to claim 4, said body comprising a foam material.

10. A buoy according to claim 9, said foam material having a specific gravity of less than about 0.5.

11. A buoy according to claim 9, said holding member being integral with the body.

12. A buoy according to claim 11, said holding member being formed of the same material as the body.

13. A buoy for supporting any one of a variety of sizes of containers in a generally upright position when the buoy and the supported container are placed in water, said buoy comprising:

a body presenting an outer perimeter and defining an opening extending through the body along an opening axis, said opening adapted to receive the container, said body defining a plurality of spaced-apart open slots extending between the opening and the outer perimeter, said open slots including an open end adjacent the opening and a closed end positioned between the opening and the outer perimeter, said open slots allowing the body to be sufficiently deformed so that the size of the opening can be varied to allow the body to receive and frictionally hold generally cylindrical containers having outer diameters varying by at least 35 percent without causing substantial plastic deformation of the body, said body comprising a resilient foam material.

14. A buoy according to claim 13, said body presenting upper and lower surfaces, each extending generally perpendicular to the opening axis when the container is removed from the opening, said slots extending from the upper surface to the lower surface.

15. A buoy according to claim 13, said body defining at least 3 of the open slots, said open slots extending from the opening into the body in a direction which is at least substantially radial with respect to the opening axis.

16. A buoy according to claim 15, said upper and lower surfaces defining a maximum body thickness measured parallel to the opening axis therebetween, said maximum body thickness being less than a minimum body width of the body.

17. A buoy according to claim 16, said maximum body thickness being less than 2 inches, said minimum body width being more than 4 inches, said opening having a minimum diameter of from about 1.5 inches to about 3.5 inches.

18. A buoy according to claim 17, said opening having a generally cylindrical shape.

19. A buoy according to claim 13, said body adapted to be elastically deformed when the container is received in the opening.

20. A buoy according to claim 13, said foam material having a specific gravity of less than about 0.5.

21. A buoy according to claim 13, and a tether having a first end coupled to the body and a second end adapted to be coupled to an anchoring device.

* * * * *